US009895913B2

(12) United States Patent
Valles Casanova et al.

(10) Patent No.: US 9,895,913 B2
(45) Date of Patent: Feb. 20, 2018

(54) PRINTING MEDIUM HOLDER

(71) Applicant: Hewlett-Packard Development Company, L.P., Houston, TX (US)

(72) Inventors: Lluis Valles Casanova, Badalona (ES); Silvestre Bruna, Sant Cugat del Valles (ES); Bernd Karlsboeck, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/167,382

(22) Filed: May 27, 2016

(65) Prior Publication Data

US 2017/0341430 A1 Nov. 30, 2017

(51) Int. Cl.

| | |
|---|---|
| ***B41J 15/04*** | (2006.01) |
| ***B41J 13/10*** | (2006.01) |
| *B41J 11/58* | (2006.01) |

(52) U.S. Cl.

CPC ..... *B41J 15/04* (2013.01); *B41J 13/10* (2013.01); *B41J 11/58* (2013.01)

(58) Field of Classification Search

CPC ..... B41J 25/304; B41J 25/312; B41J 25/316; B41J 2/32; B41J 15/04; B41J 15/00; B41J 13/10; B41J 11/58

See application file for complete search history.

(56) References Cited

U.S. PATENT DOCUMENTS

| | | | | |
|---|---|---|---|---|
| 5,302,037 | A | 4/1994 | Schoendienst | |
| 5,397,191 | A * | 3/1995 | Murakami | B41J 3/28 400/624 |
| 6,390,697 | B1 | 5/2002 | O'Mera | |
| 7,909,522 | B2 * | 3/2011 | Heaton | B41J 3/36 242/578 |
| 8,233,835 | B2 | 7/2012 | Martin et al. | |
| 9,254,698 | B2 | 2/2016 | Vila et al. | |
| 2013/0298790 | A1 | 11/2013 | Castells et al. | |

OTHER PUBLICATIONS

Webpage retrieved on Apr. 13, 2016. HP Support Center: HP Latex 3000 Printer Series—Handle the substrate ~ 30 pages.

* cited by examiner

*Primary Examiner* — Sharon A Polk
(74) *Attorney, Agent, or Firm* — HP Inc. Patent Department

(57) ABSTRACT

A printing medium holder system is described which has first and second printing medium holders, a connection mechanism to connect the holder system to a printer and a pivot mechanism. The pivot mechanism is connected to each of the first printing medium holder, the second printing medium holder and the connection mechanism. The pivot mechanism is pivotable so that each of the first printing mechanism holder and the second printing mechanism holder move relative to the connection mechanism between a first configuration of the holder system and a second configuration of the holder system. A printing system and a printing device are also described.

18 Claims, 10 Drawing Sheets

PRINTING MEDIUM HOLDER

BACKGROUND

In many printing devices, a printing medium passes from an input holder to an output holder via a printing medium path, the printing medium path including a printing zone in which a printing element prints on the printing medium is printed on. The two holders may be disposed on the same side of the printer, or on opposing sides, for example. The holders may take the form of rolls, for example, and the media holders may be accessed in order to, for example, re-supply the input holder and/or to remove a medium on which printing has been completed from the output holder.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Figure 1A:
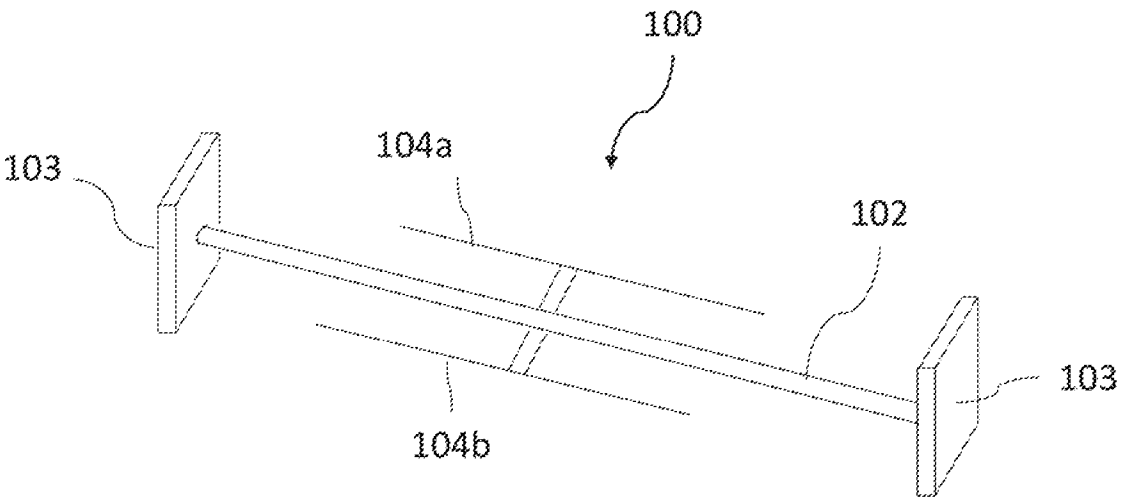
FIG. 1*a* is block diagram of a printing medium holder system according to an example.

FIG. 1*a* is a block diagram schematically illustrating the components of an example printing medium holder system 100, herein referred to as a "holder system 100". FIG. 1*a*, as well as other figures referenced herein, are schematic diagrams and as such certain components have been omitted to facilitate a description of the example. Actual implementations may vary in practice.

The holder system 100 includes a first printing medium holder 104*a*, and a second printing medium holder 104*b*, referred to herein as the "first holder 104*a*" and "second holder 104*b*" respectively. The holder system 100 includes a connection mechanism 103 to connect the holder system to a printer. The holder system 100 also includes a pivot mechanism 102, connected to each of the first holder 104*a*, the second holder 104*b* and the connection mechanism 103. The pivot mechanism 102 is pivotable so that the first holder 104*a* and the second holder 104*b* move relative to the connection mechanism 103 between a first configuration of the holder system 100 and a second configuration of the holder system 100.

Figure 1B:
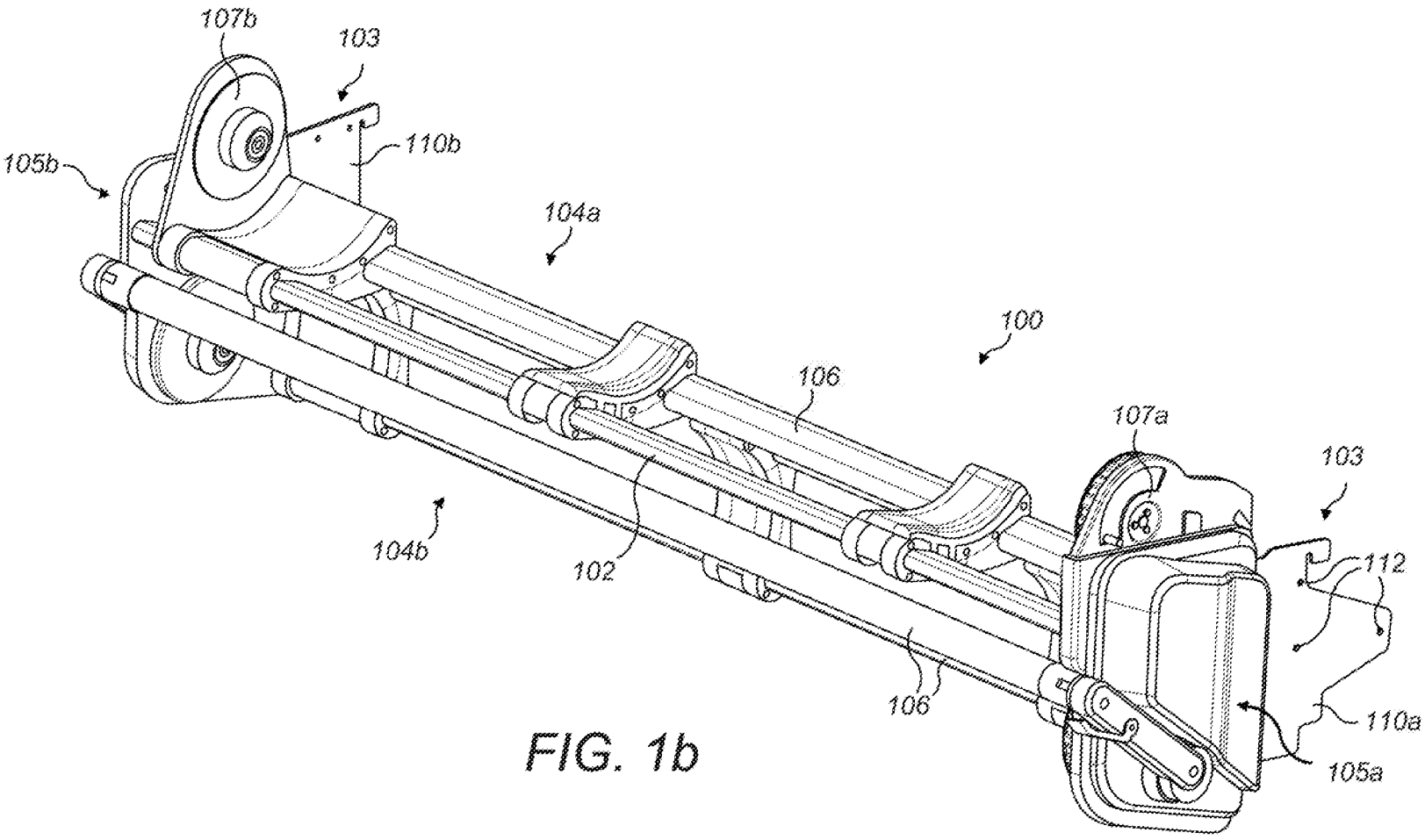
FIG. 1*b* is a perspective diagram of a printing medium holder system according to an example.
Figure 1C:
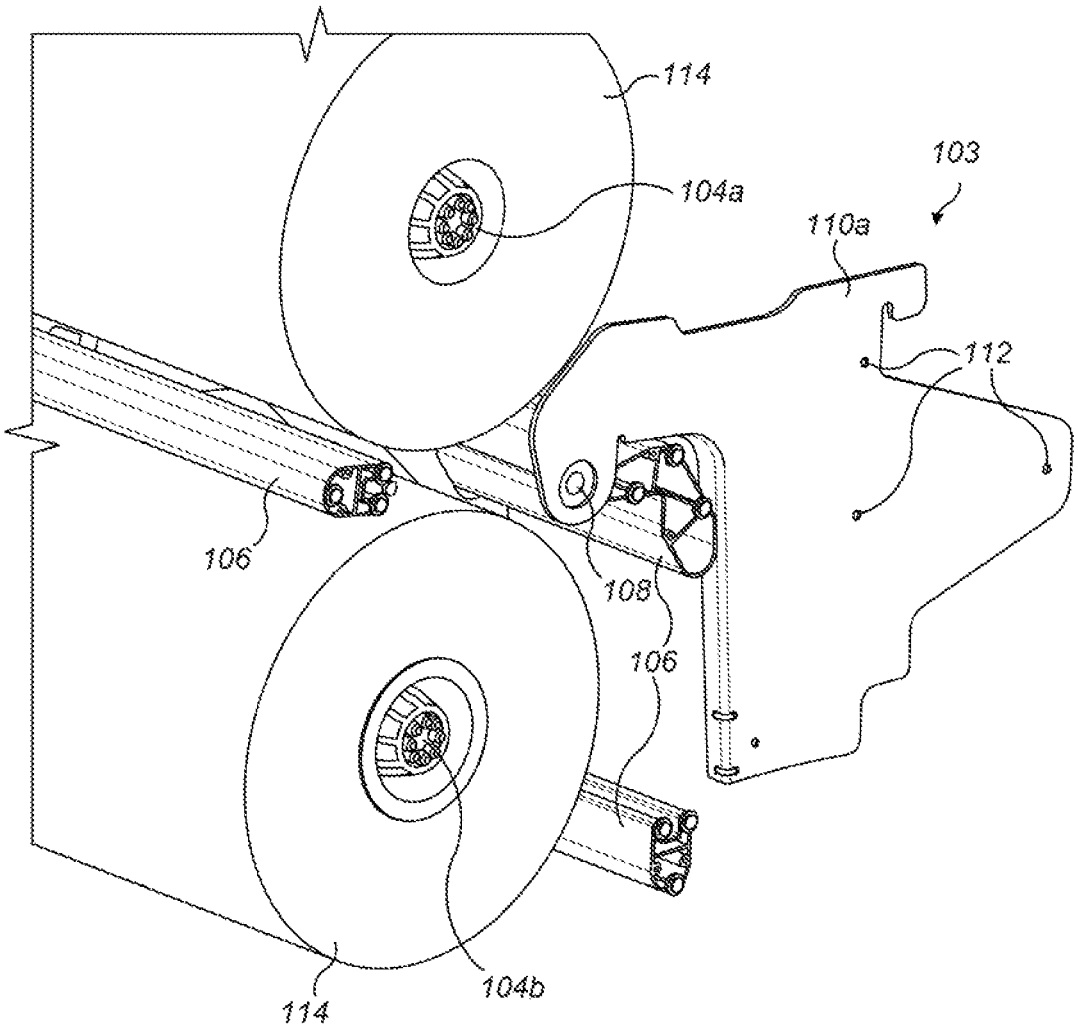
FIG. 1*c* is an end perspective diagram of the printing medium holder system of FIG. 1*b;*

FIGS. 1*b* and 1*c* schematically illustrate an example of a holder system 100 according to FIG. 1*a*. FIG. 1*b* shows a holder system 100 not holding a printing medium. FIG. 1*c* and subsequent figures show the holder system 100 holding a printing medium 114.

The holders 104*a*, 104*b* of the example holder system 100 of FIGS. 1*b* and 1*c* are between opposing end parts 105*a*, 105*b* of the holder system 100. The holders 104*a*, 104*b* may be in the form of media roll holders, for example. In the example of FIGS. 1*b* and 1*c*, the holders include opposing medium supports 107*a*, 107*b* between which a medium roll 114 may be held, by fitting the supports 107*a*, 107*b* into opposing ends of the medium roll, in a clamping arrangement, for example. In this example, the holders 104*a*, 104*b* include support arms 106 to hold the printing medium 114 in place.

The holders 104*a*, 104*b* may facilitate removal of the printing medium 114, so that the printing medium 114 may be replaced, for example. For example, the medium support 107*b* may be slidably movable on the support arms 106 to vary the distance between the medium supports 107*a*, 107*b* to facilitate the fitting and removal of the support medium 114 and/or to accommodate different sizes of printing medium 114. Printing media 114 that the holders 104*a*, 104*b* may support include paper, flexible card, textiles, or any other type of medium.

The connection mechanism 103 in this example takes the form of a support structure comprising support plates 110*a*, 110*b* at respective ends of the holding system and holes 112 (which may be threaded), which may be used to fix the holder system to a printing device, as described below.

The pivot mechanism in this example takes the form of a rotatable shaft 102. The shaft 102 passes through a hole 108 in each of the support plates 110*a*, 110*b*, and connects to end parts 105*a* and 105*b*. The shaft can be rotated in the hole 108 and thus rotatably coupled to the support plates 110*a*, 110*b*. In some examples, the shaft 102 is mounted in the hole 108 on bearings (not shown). The holders 104*a*, 104*b*, are thus fixedly coupled to the shaft 102 via the end parts 105*a*, 105*b*, forming a rigid structure which can pivot within the hole 108 in the support plate 110*a*, so that with the shaft 102 forms a common axis of rotation about which the holders 104*a*, 104*b* pivot. That is, the holders 104*a*, 104*b* move relative to the connection mechanism 103 by rotating concurrently with the shaft 102.

Figure 2A:
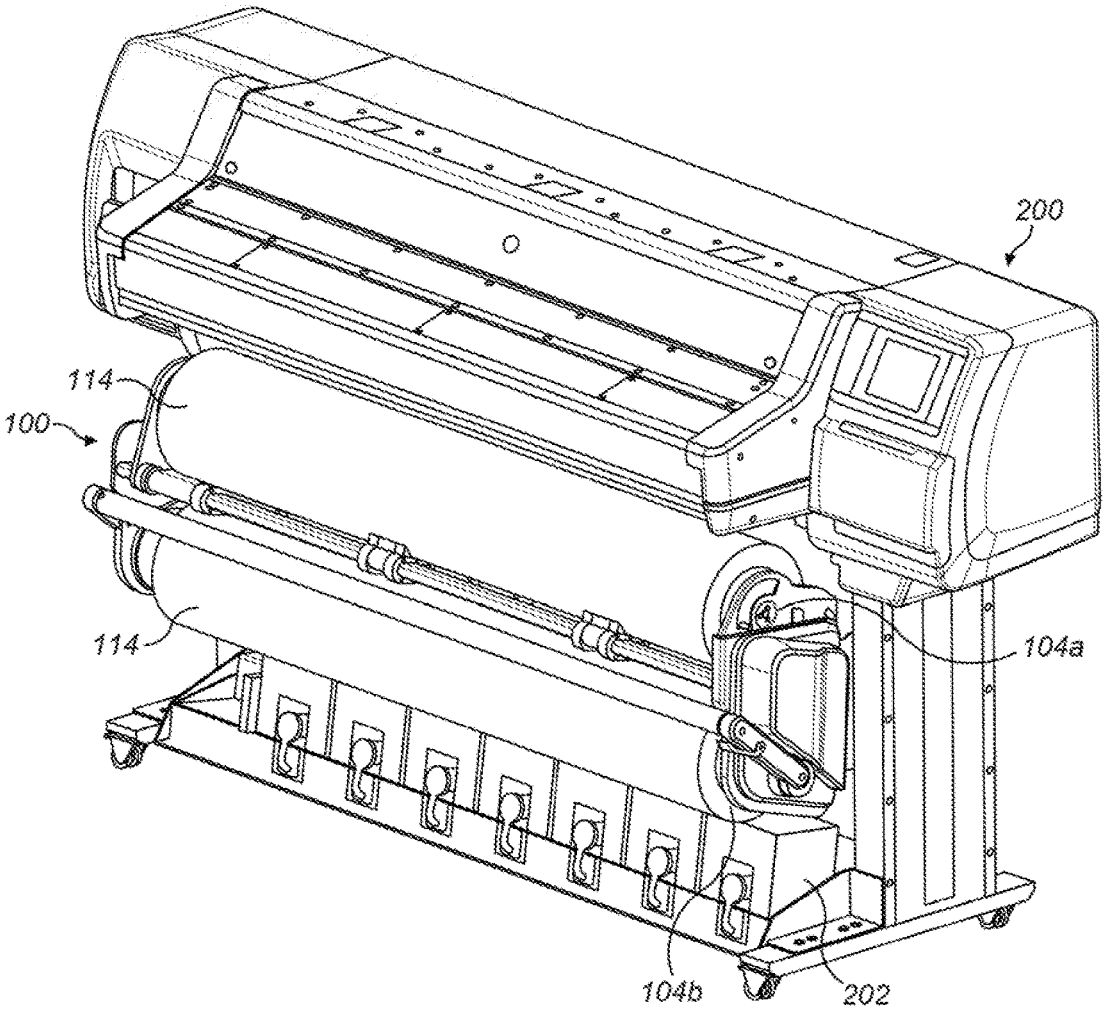
FIG. 2*a* is a perspective view of a printing system according to an example including the printing medium holder system of FIG. 1*b* in a first configuration.
Figure 2B:
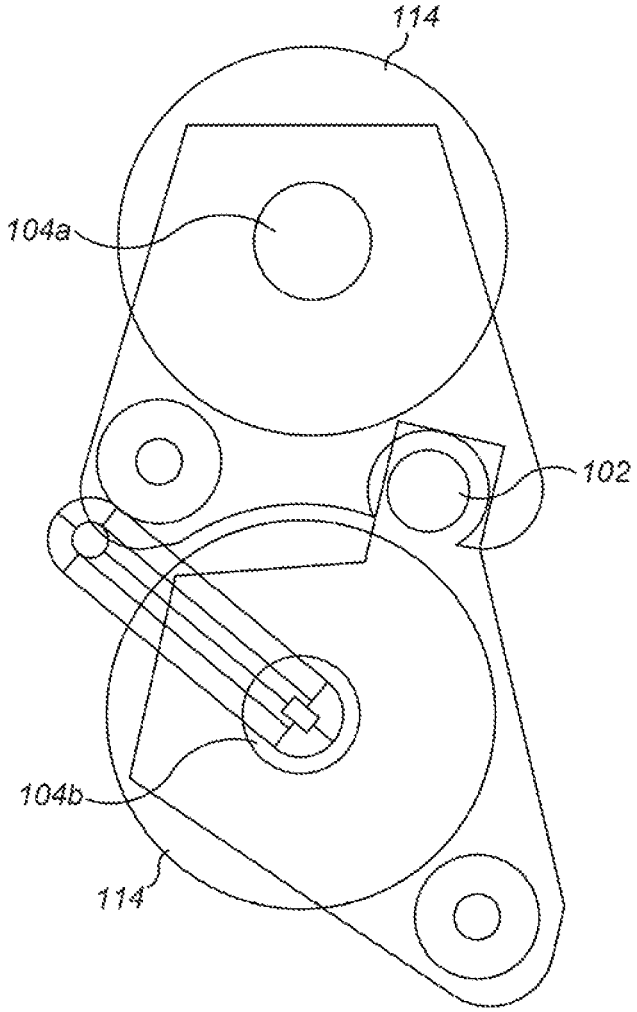
FIG. 2*b* is a schematic cross-section diagram of the printing medium holder system of FIG. 1*b* in the first configuration.

FIGS. 2*a* and 2*b* illustrate a holder system 100 according, to any example fitted to a printing device 200, herein referred to as a printer 200. The printer 200 may be any suitable type of printer, for example an inkjet printer, laser printer or thermal transfer printer. The holder system 100 may be fitted to the printer 200 by passing screws through the holes 112 in the support plate 110*a* into receiving holes (not shown) in the body of the printer. The printer 200 includes a space below the holder system 100 in which accessories 202, such as ink supplies may be stored.

Figure 2C:
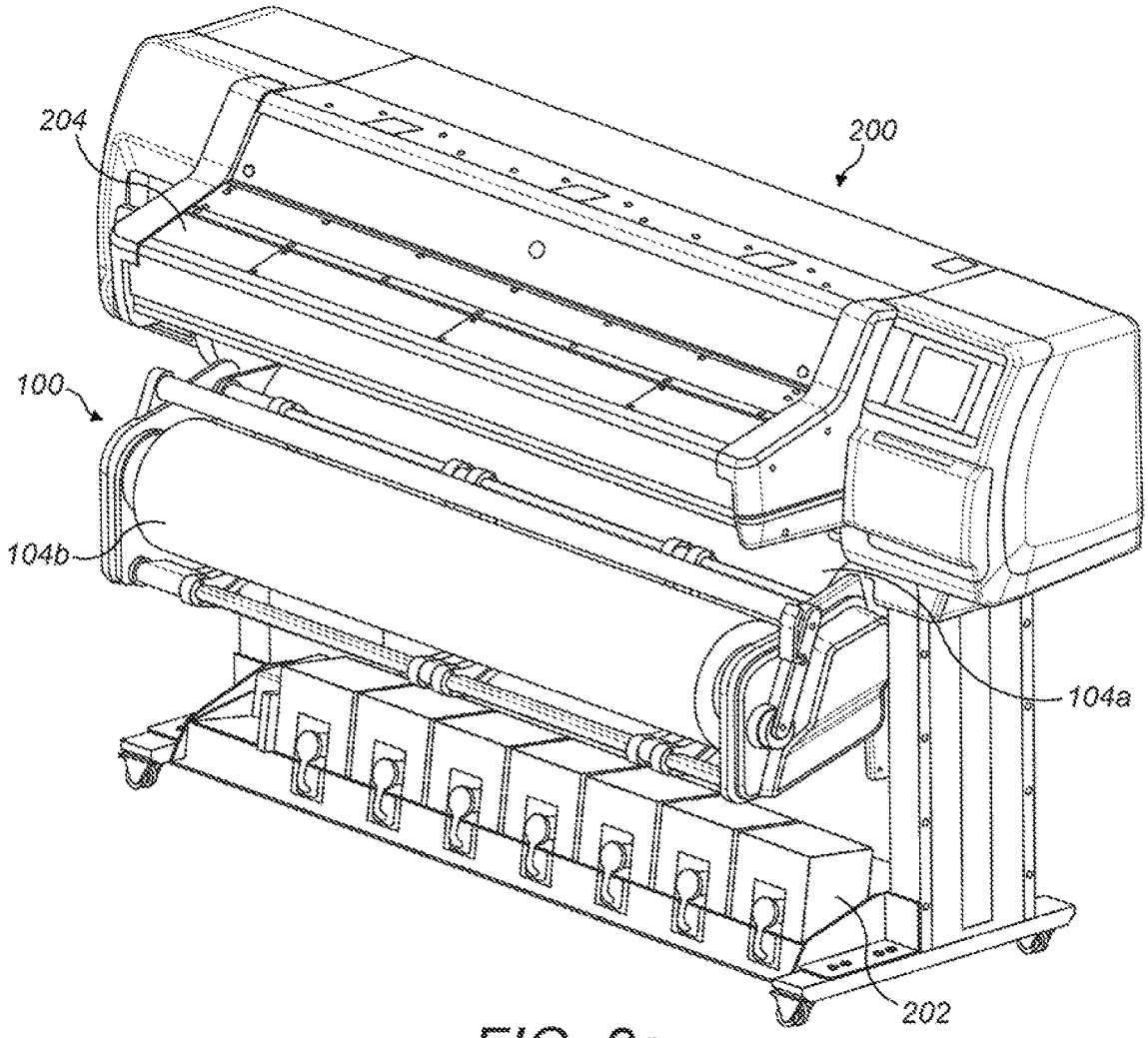
FIG. 2*c* a perspective view of a printing system according to an example including the printing medium holder system of FIG. 1*b* in a second configuration.
Figure 2D:
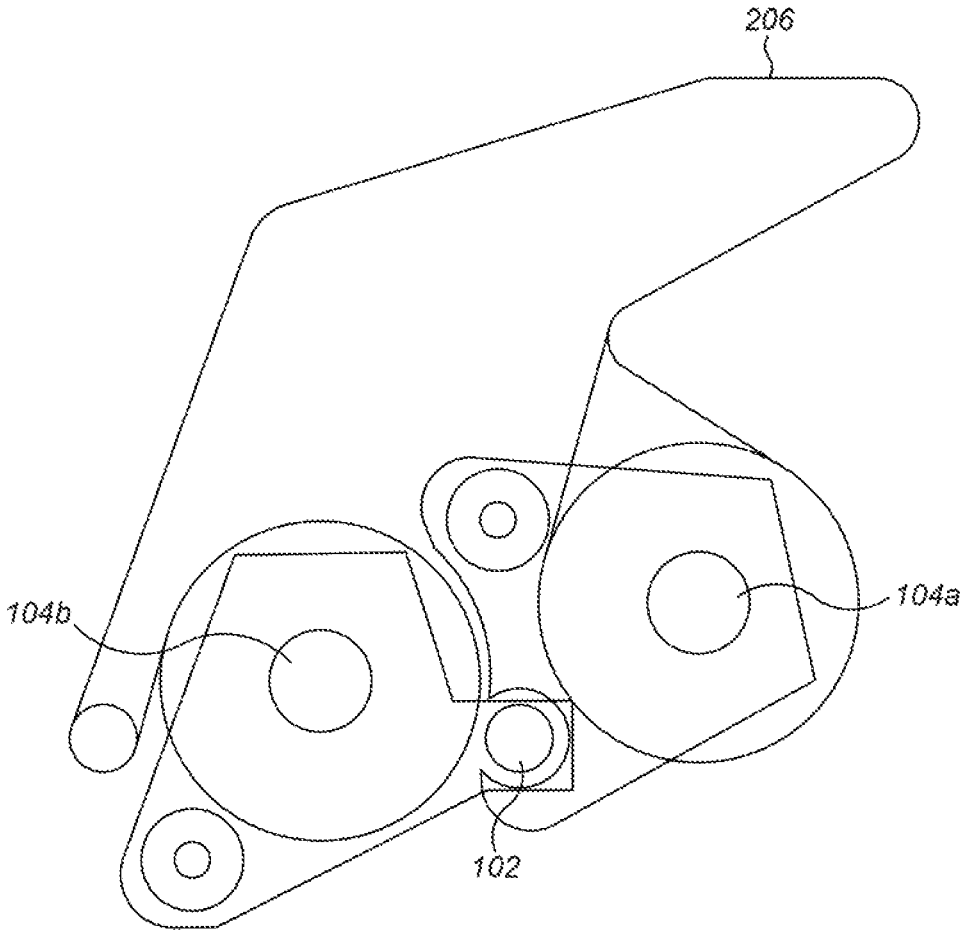
FIG. 2*d* is a schematic cross-section diagram of the printing medium holder system of FIG. 1*b* in the second configuration and a printing medium path of the printing system.

In the example of FIGS. 2*a* and 2*b*, the holder system 100 is in a first configuration, in which the second holder 104*b* is in a position below the position of the first holder 104*a*, so that the holders 104*a*, 104*b* are at substantially the same vertical plane. FIGS. 2*c* and 2*d* show an example in which the holder system 100 is in a second configuration, in which the positions of the first holder 104*a* and the second holder 104*b* are at substantially the same height i.e. the first holder 104*a* and the second holder 104*b* are held side-by-side with respect to a horizontal plane. The holder system 100 may be moved between the first and second configurations by an operator, such as a human operator, holding the end parts 105*a*, 105*b* and rotating (pivoting) the holder system 100, so that the holders 104*a*, 104*b* move (rotate) concurrently with respect to the connection mechanism 103 and printer 200. In this example, the rotation between the first and second configurations is through approximately 90 degrees.

When printing, the printing medium 114 passes along the printing media path 206 shown in FIG. 2*d* between the first holder 104*a* and second holder 104*b*, passing through a printing zone 204 of the printer 200, which may include printing elements (not shown) for printing on the printer medium 114. In one example, the second holder 104*b* is an input holder from which the printing medium 114 is provided to the printing zone, and the first holder 104*a* is an output holder where the printing medium 114 is collected after printing. In another example, the first holder 104*a* is an input holder and the second holder 104*b* is an output holder.

In the above example, the holder system 100 is in the second configuration when printing. However, in other examples, printing may be performed with the holder system 100 in the first configuration. A diverter may be used for this purpose, for example. In still other examples, it is possible to perform printing with the holder system 100 in either the first configuration or the second configuration.

When the holder system 100 is in the first configuration, the first holder 104*a* is externally accessible and when the holder system 100 is in the second configuration, the second holder 104*b* is externally accessible, for example by a human operator. This enables, for example, the printing medium 114 to be removed and/or supplied to each of the holders 104*a*, 104*b*, by changing the configuration of the holder system 100. Thus, both holders 104*a*, 104*b* can be accessed from the same side of the printer 200, which enables, for example, the printer 200 to be placed next to another object, such as a wall, without access being inhibited.

In some examples, the height of the first holder 104*a* in the first position is substantially the same as the height of the second holder 104*b* in the second configuration. Thus, an operator may access and manipulate each of the holders 104*a*, 104*b* at substantially the same height, alleviating the operator from, for example, having to adopt stressful postures to access a holder.

The amount of space under the holder system 100 which may be used for storing accessories 202 may be increased compared to prior art in which holders are held at fixed positions above one another. For example, the holder system 100 may be put into the second configuration to increase the space available under the holder system 100, facilitating access thereto.

Figure 3A:
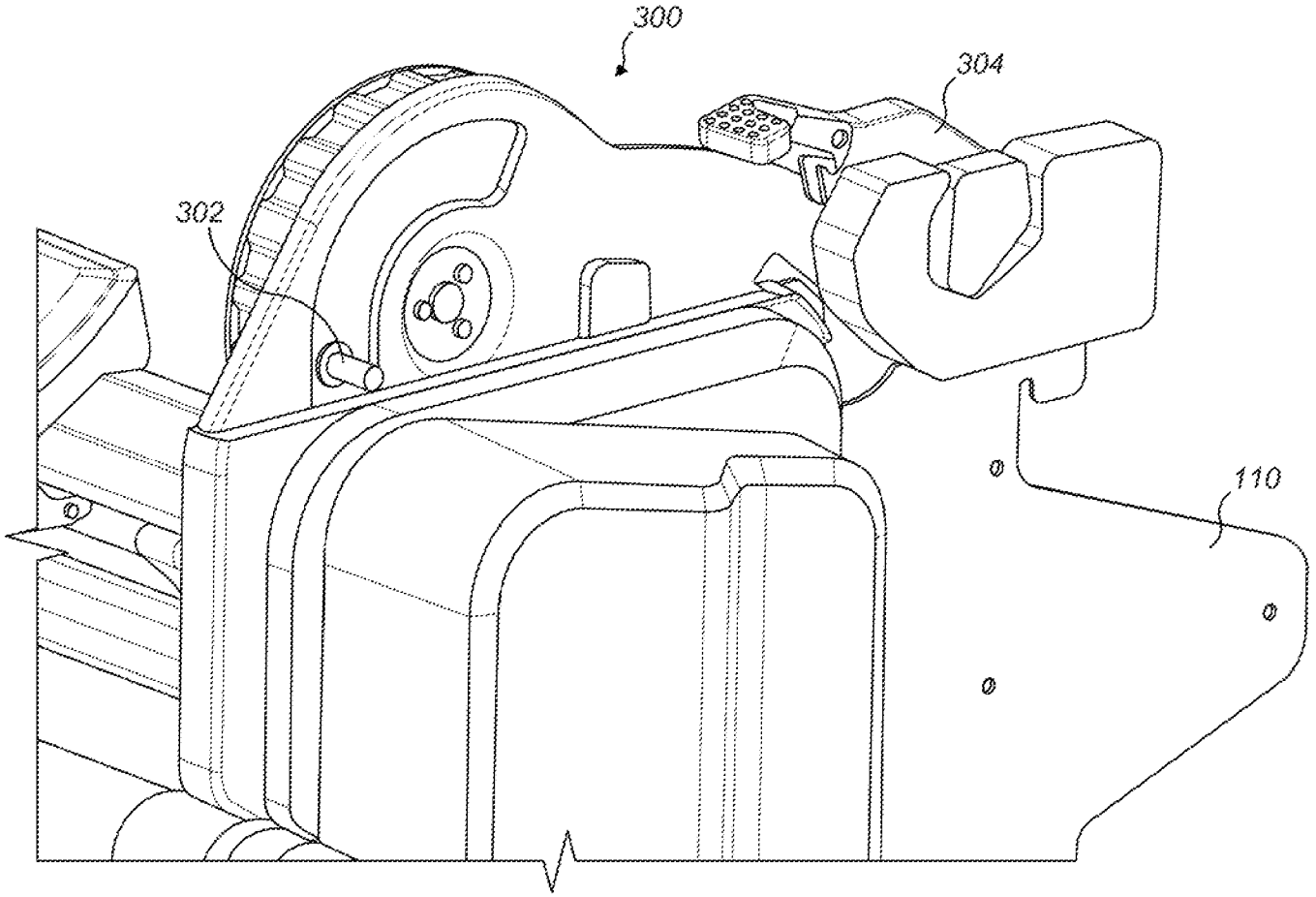
FIG. 3*a* is a perspective diagram of a fixing mechanism for fixing the printing medium holder system of FIG. 1*b* in the second configuration.
Figure 3B:
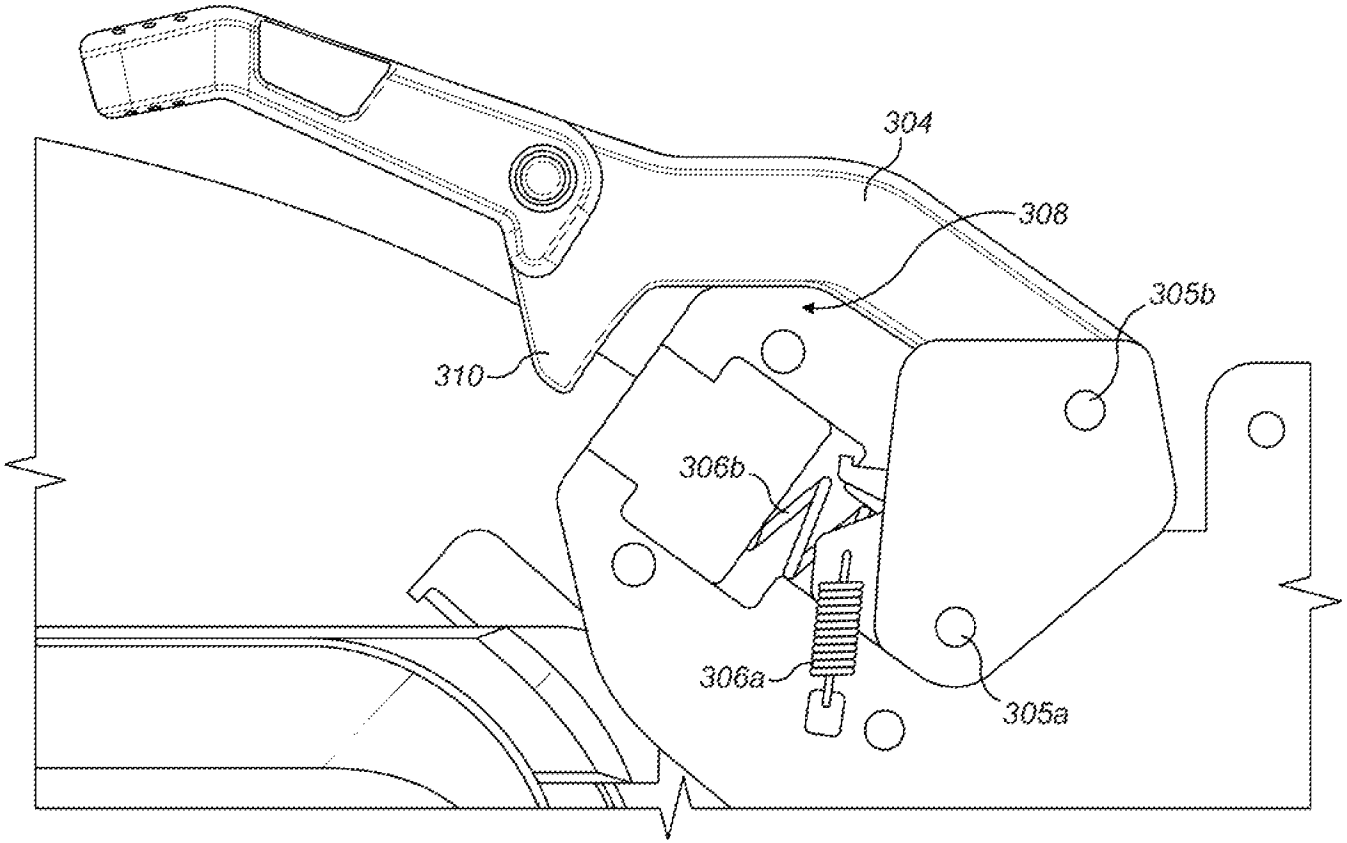
FIG. 3*b* is schematic diagram of the fixing mechanism of Figure a viewed from the side.

In some examples, one or both of the first and second configurations are stable configurations, in which the holder system 100 is held in a stable respective position. FIGS. 3*a* and 3*b* illustrate an example of fixing mechanism 300 to fix the holder system 100 in the second configuration. In this example, the fixing mechanism 300 is a lever mechanism comprising a protruding part 302, herein referred to as a catch 302 on an end of the first holder 104*a*, and a lever 304 on the support plate 110*a*. In this example, the lever 304 is mounted on pivots 305*a*, 305*b* and attached to resilient members in the form of a first spring 306*a* and a second spring 306*b*. When moving the holder system 100 from the first configuration to the second configuration, the rotation of the holder system 100 causes catch 302 to engage with a protrusion 310 on the lever 304, forcing the lever 304 upwards, tensioning the springs 306*a*, 306*b* as it does so. As the holder system 100 is rotated further, the catch 302 moves into a recess 308 of the lever, and the tension in the springs 306*a*, 306*b* biases the lever 304 downwards, thereby holding the catch 302 in place against the protrusion 310. In that example, the lever is in an engaged state (e.g., lowered). This enables the holder system 100 to be fixed in place in the second configuration.

When moving the holder system 100 from the second configuration to the first configuration, the lever 304 may be placed in a release state (e.g., raised), for example, by a human operator, and the catch 302 thereby released, enabling the holder system 100 to be pivoted to the first configuration. Once the holder system 100 has been pivoted to the first configuration, the weight of the holder system 100 may keep the holder system 100 stable in the first configuration, for example. The holder system 100 thus pivots between the first configuration and the second configuration based on engagement of the lever mechanism 300.

Figure 4:
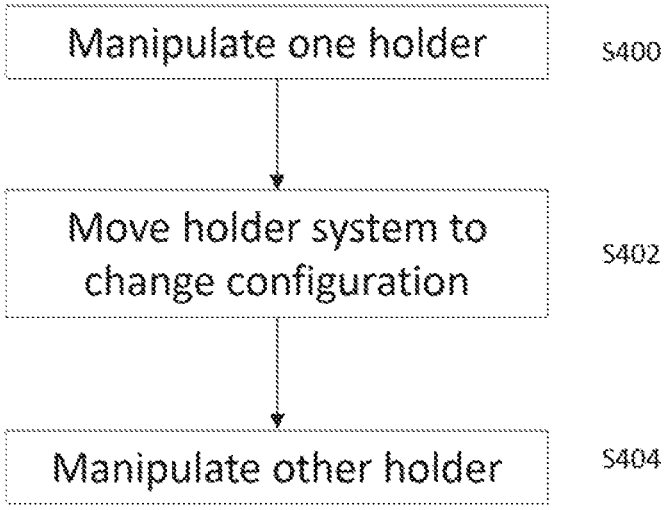
FIG. 4 is a flow diagram showing a method for use with the printing system of FIGS. 2*a* and 2*c*.

FIG. 4 is a flow diagram showing a method of using the printing system 100. At block S400 an operator manipulates one of the holders 104*a*, 104*b*, with the holder system 100 in either the first configuration or the second configuration. For example, the holder system 100 may in the first configuration with the first holder 104*a* accessible. The first holder 104*a* may be an input holder, input holder and the manipulation may comprise supplying a blank (unprinted) printing medium 114 for example.

At block 402, the operator changes the configuration of the holder system 100. For example, the operator may change the configuration from the first configuration to the second configuration by causing the holder system 100 to pivot about the shaft 102, through approximately 90 degrees, bringing the second holder 104*b* to substantially the same height as the first holder 104*a*. The holder system 100 may be held in the second configuration by the fixing mechanism 300 described above, for example.

At block S404, the operator manipulates the holder 104*a*, 104*b* which was not manipulated at block S400. For example, the operator may manipulate the second holder 104*b*. The second holder 104*b* may be an output holder and the manipulation may comprise removing a printing medium on which printing is completed, for example. With the holder system 100 in the second configuration, the operator may additionally access the accessories stored under the holder system 100, to replenish ink supplies, for example.

The above arrangements are to be understood as illustrative examples. Further arrangements and modifications to those arrangements are envisaged. For example, although in the above examples, the holder system 100 was described as being caused to pivot between the first and second configurations by manual manipulation, in some examples an electric or other motor may cause the pivoting.

It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the accompanying claims.

What is claimed is:

1. A printing medium holder system comprising:

a first printing medium holder;

a second printing medium holder;

a connection mechanism to connect the holder system to a printer, wherein the connection mechanism comprises a plate to connect to the printer; and a pivot mechanism connected to each of the first printing medium holder, the second printing medium holder and the connection mechanism, the pivot mechanism being pivotable so that each of the first printing medium holder and the second printing medium holder move relative to the connection mechanism between a first configuration of the holder system and a second configuration of the holder system.

2. The printing medium holder system of claim 1, wherein the first configuration and the second configuration are stable configurations.

3. The printing medium holder system of claim 2, comprising a fixing mechanism to fix at least one of the first printing medium holder and the second printing medium holder in place in the first configuration.

4. The printing medium holder system of claim 3, wherein the fixing mechanism comprises:

a protruding part protruding from the printer medium holder system, and a lever mechanism to receive the protruding part, the lever mechanism being attached to the connection mechanism.

5. The printing medium holder system of claim 4, wherein the lever mechanism comprises a lever including a recess to receive the protruding part, and a resilient member to bias the lever towards a position in which the protruding part is held in the recess.

6. The printing medium holder system of claim 1, wherein the pivot mechanism comprises a shaft located in a hole of the connection mechanism.

7. The printing medium holder system of claim 6, wherein the shaft is rotatable in the hole.

8. The printing medium holder system of claim 1, comprising a support member attached to the pivot mechanism to support a printing medium.

9. The printing medium holder system of claim 1, wherein, in the first configuration, the first printing medium holder and the second printing medium holder are both held substantially at a given height, and pivoting the medium holder system from the second configuration to the first configuration provides access to a component of the printer underneath the medium holder system.

10. The printing medium holder system of claim 1, wherein the first printing medium holder and the second printing medium holder comprise an adjustable end to accommodate various sizes of roll media.

11. The printing medium holder system of claim 1, wherein:

when in the first configuration, the first printing medium holder and the second printing medium holder are at substantially the same height; and when in the second configuration, the first printing medium holder and the second printing medium holder are at substantially the same vertical plane.

12. A printing system comprising:

a medium holder system comprising a first printing medium holder and a second printing medium holder; and a structure defining a printing medium path in a printing device between the first printing medium holder and the second printing medium holder, the medium holder system being pivotably mounted to the printing device so that the first printing medium holder and the second printing medium holder are pivotable about a common axis between a first position and a second position, wherein, in the first position, the first printing medium holder is accessible from the exterior of the printing system and is at a given height.

13. The printing system of claim 12, wherein, in the second position, the second printing medium holder is accessible from the exterior of the printing system and is substantially at the given height.

14. The printing system according to claim 12, wherein, in the first position, the first printing medium holder and the second printing medium holder are both held substantially at the given height, and pivoting the medium holder system from the second position to the first position provides access to a component of the printing system underneath the medium holder system.

15. A printing device comprising:

a medium holder system comprising:

a support structure;

a pivot rotatably coupled to the support structure;

a first printing medium holder fixedly coupled to the pivot; and a second printing medium holder fixedly coupled to the pivot; and a lever coupled to the medium holder system to concurrently pivot the first printing medium holder and the second printing medium holder between a first configuration and a second configuration based on engagement of the lever, wherein, in the first configuration, the first printing medium holder and the second printing medium holder are both held substantially at a given height, and the pivoting of the first printing medium holder and the second printing medium holder from the second configuration to the first configuration provides access to a component of the printing device underneath the medium holder system.

16. The printing device of claim 15, wherein the first printing medium holder and second printing medium holder are to pivot through 90 degrees.

17. The printing device according to claim 15, wherein the first printing medium holder and the second printing medium holder comprise an adjustable end to accommodate various sizes of roll media.

18. The printing device of claim 15, wherein:

when in the second configuration, the first printing medium holder and the second printing medium holder are at substantially the same vertical plane.

* * * * *